US007456816B2

(12) United States Patent
Chen

(10) Patent No.: US 7,456,816 B2
(45) Date of Patent: Nov. 25, 2008

(54) LAMP FREQUENCY CONTROL SYSTEM FOR DISPLAY AND METHOD FOR CONTROLLING LAMP FREQUENCY

(75) Inventor: Shih-Ming Chen, Tainan County (TW)

(73) Assignee: Chi Mei Optoelectronics Corp. (TW)

( * ) Notice: Subject to any disclaimer, the term of this patent is extended or adjusted under 35 U.S.C. 154(b) by 0 days.

(21) Appl. No.: 11/101,169

(22) Filed: Apr. 7, 2005

(65) Prior Publication Data

US 2005/0258780 A1 Nov. 24, 2005

(30) Foreign Application Priority Data

Apr. 8, 2004 (TW) ..... 93109787 A

(51) Int. Cl.
*G09G 3/36* (2006.01)

(52) U.S. Cl. ..... 345/98; 345/96; 345/3.2; 345/690; 345/214

(58) Field of Classification Search ..... 345/3, 345/2, 3.3, 3.1, 54, 51, 48, 55, 89, 90, 95–98, 345/102, 600, 690, 214, 211, 209
See application file for complete search history.

(56) References Cited

U.S. PATENT DOCUMENTS 6,046,737 A * 4/2000 Nakamura ..... 345/213
6,518,712 B2 * 2/2003 Weng ..... 315/209 R
2004/0021625 A1 * 2/2004 Lee ..... 345/87
2004/0217715 A1 * 11/2004 Yang et al. ..... 315/209 R
2006/0022929 A1 * 2/2006 Hashimoto et al. ..... 345/96

* cited by examiner

*Primary Examiner*—Tuyet Vo
(74) *Attorney, Agent, or Firm*—Ladas and Parry LLP

(57) ABSTRACT

The invention relates to a lamp frequency control system for a display and method for controlling the lamp frequency. The lamp frequency control system comprises a driving control device and a lamp frequency control device. The driving control device has a driving mode selector for selecting a driving mode from at least two driving modes. According to the selected driving mode, the driving mode selector outputs at least one corresponding frequency control signal. According to the corresponding frequency control signal, the lamp frequency control device obtains at least one corresponding lamp frequency. According to the various driving mode, the lamp frequency control system of the invention obtains the corresponding lamp frequency. That is, the lamp frequency can be adjusted to match the driving mode. Therefore, the lamp frequency can be adjusted at a frequency section without the water flow interference. The lamp frequency control system of the invention can resolve the water flow interference.

11 Claims, 3 Drawing Sheets

LAMP FREQUENCY CONTROL SYSTEM FOR DISPLAY AND METHOD FOR CONTROLLING LAMP FREQUENCY

BACKGROUND OF THE INVENTION

1. Field of the Invention

The invention relates to a frequency control system and method, and particularly, to a lamp frequency control system for a display and method for controlling lamp frequency.

2. Description of the Related Art

Referring to FIG. 1, for a conventional lamp 11 of a display (such as a liquid crystal display), a direct current (DC) is converted to an alternating current (AC) by a converter 12 to supply a desired power to the lamp. A display panel 15 of the display is driven by a driving device 16 to display. The driving modes of the conventional driving device 16 include various modes, such as dot inversion and column inversion modes. Each of the driving modes has a different driving manner and scanning frequency.

As currently known, a water flow interference may be induced by the interaction of the operating frequency and the scanning frequency of the converter. There are three conventional solutions for improving the water flow interference, wherein the first solution is to shield the electromagnetic interference with a indium tin oxide (ITO) layer; the second solution is to employ a converter having an operating frequency in sync with a horizontal scanning frequency; and the third solution is to alleviate the water flow interference by offsetting the intensity of the electric field interference with two neighboring lamps of opposite polarities.

However, the first solution has a high cost, and the ITO layer will be etiolated due to the quality problem, thereby inducing color difference. In the second solution, the horizontal scanning frequency must be precisely locked where any variation may immediately lead to the water flow interference. The third solution is only to alleviate the water flow interference, but no capable of completely eliminating the water flow interference.

In addition, the conventional driving device 16 may be controlled by switching between at least two driving modes (such as dot inversion and column inversion). However, under the driving mode switching condition, it is impossible to lock the horizontal scanning frequency precisely to match the operating frequency of the converter. Therefore, for a display having a driving device with at least two driving modes, the second solution cannot be employed to resolve the water flow interference.

Therefore, it is necessary to provide a lamp frequency control system for a display and method for controlling lamp frequency to resolve the abovementioned problem.

SUMMARY OF THE INVENTION

The object of the invention is to provide a lamp frequency control system for a display and method for controlling lamp frequency. The lamp frequency control system comprises a driving control device and a lamp frequency control device. The driving control device has a driving mode selector for selecting a driving mode from at least two driving modes. According to the selected driving mode, the driving mode selector outputs at least one corresponding frequency control signal. According to the corresponding frequency control signal, the lamp frequency control device obtains at least one corresponding lamp frequency.

According to the various driving modes, the lamp frequency control system of the invention obtains the corresponding lamp frequency. That is, the lamp frequency can be adjusted to match the driving mode. Therefore, the lamp frequency can be adjusted at a frequency section without the water flow interference, and the water flow interference can be resolved by the lamp frequency control system of the invention according to the invention.

DETAILED DESCRIPTION OF THE INVENTION

Figure 1:
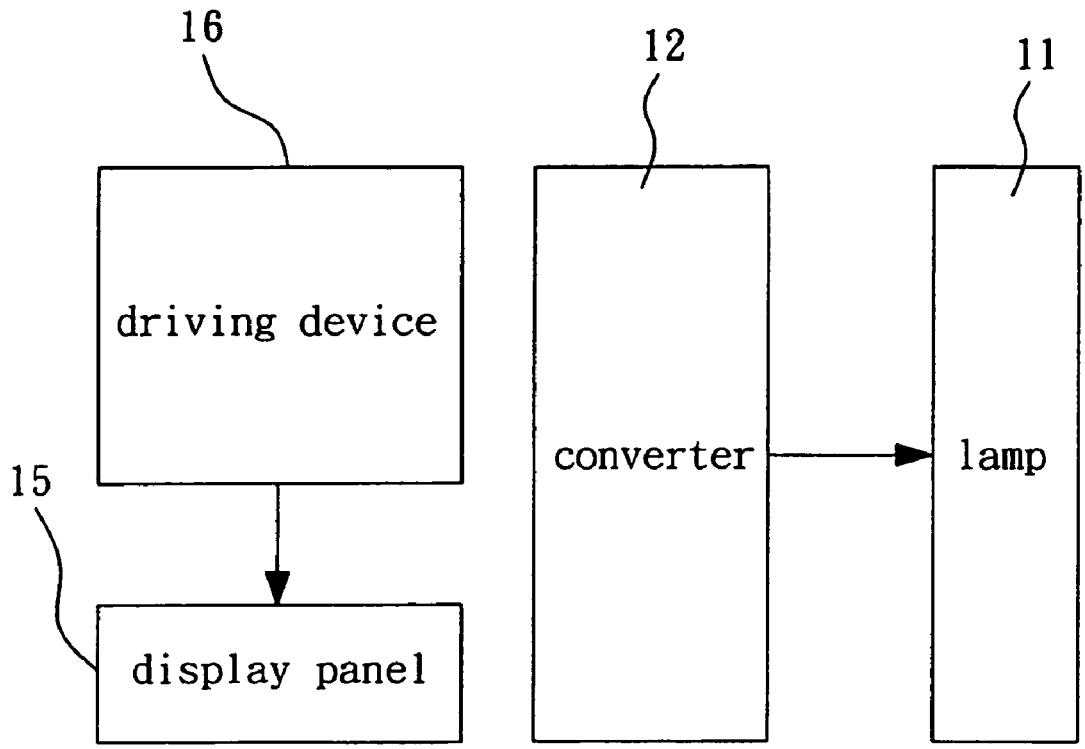
FIG. 1 PRIOR ART
FIG. 1 is a schematic view of a conventional display lamp frequency control and driving control display panel.
Figure 2A:
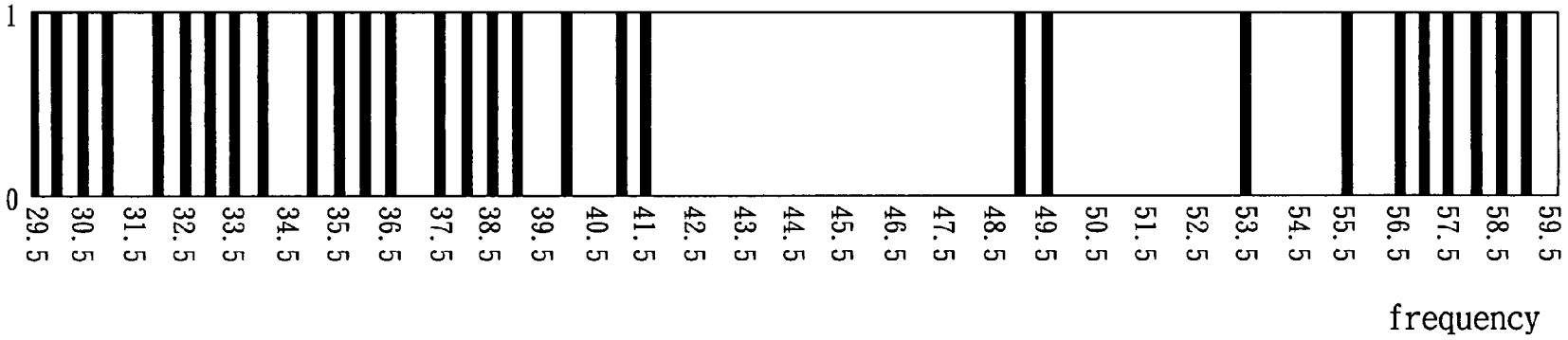
FIG. 2A is a diagram showing the analytic result for a water flow interference frequency spectrum in a dot inversion mode.
Figure 2B:
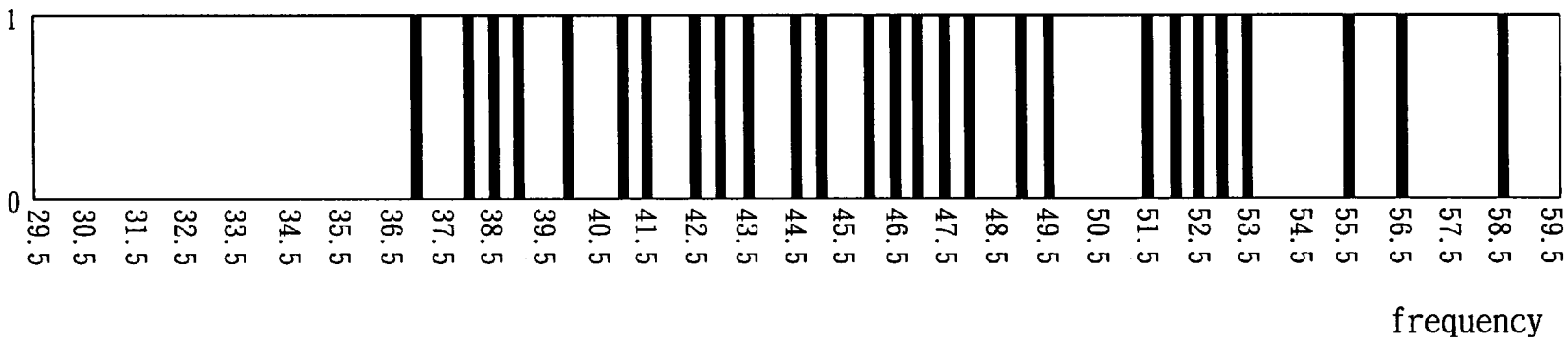
FIG. 2B is a diagram showing the analytic result for a water flow interference frequency spectrum in a column inversion mode.

Referring to FIGS. 2A and 2B, analytic results for the water flow interference frequency spectrums are illustrated. FIG. 2A shows the analytic result for a water flow interference frequency spectrum in a dot inversion mode, wherein no water flow interference is found between 41 KHz and 48.5 KHz. Referring to FIG. 2B, the analytic result for a water flow interference frequency spectrum in a column inversion mode is shown, wherein no water flow interference is found between 29.5 KHz and 36.5 KHz.

Figure 3:
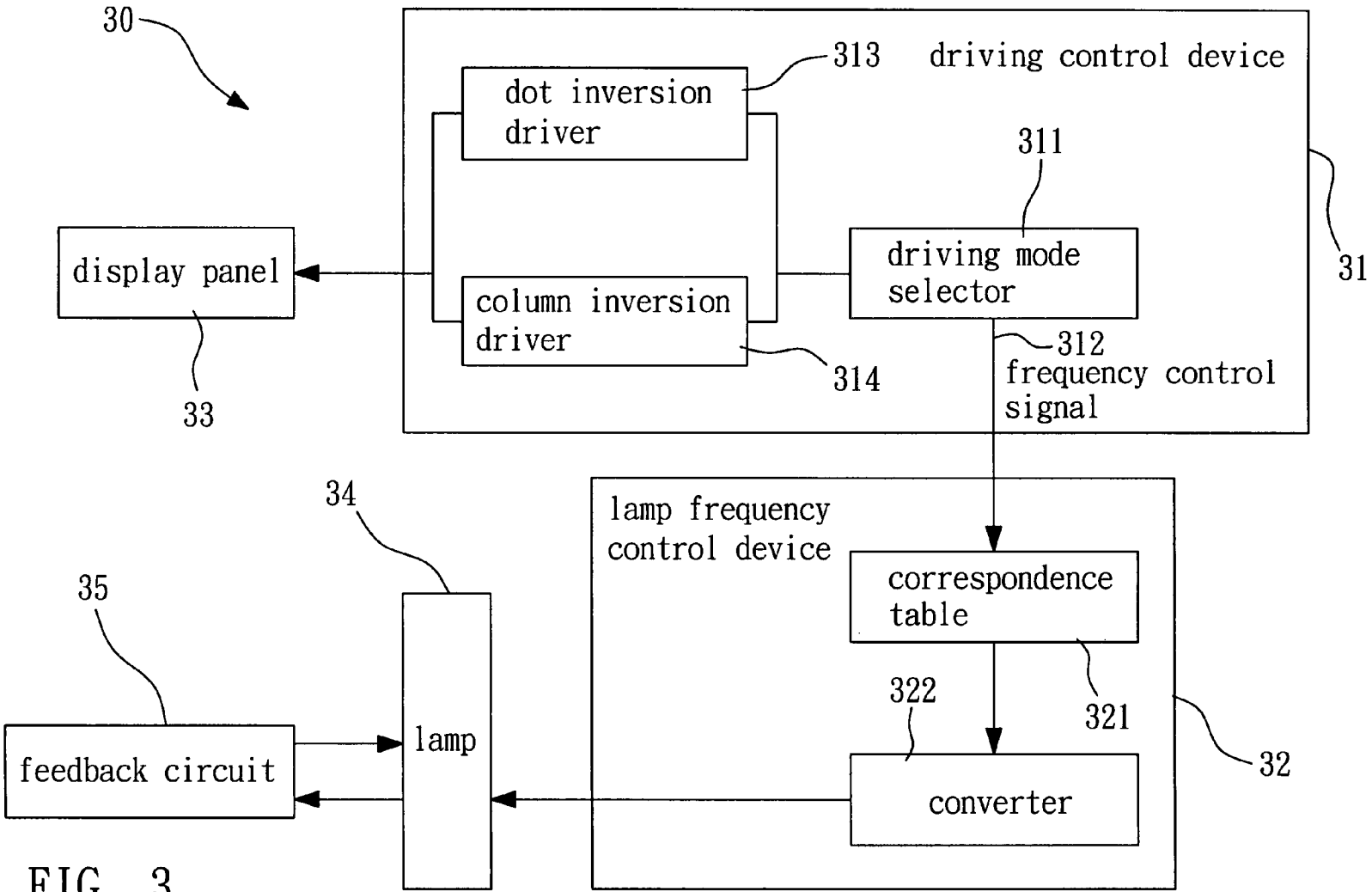
FIG. 3 is a schematic view of a lamp frequency control system for a display according to the invention.

Referring to FIG. 3, according to the invention, a lamp frequency control system 30 for a display comprises a driving control device 31 and a lamp frequency control device 32. The driving control device 31 has a driving mode selector 311 for selecting a driving mode from at least two driving modes. According to the selected driving mode, the driving mode selector 311 outputs at least one corresponding frequency control signal 312.

The driving mode of the driving control device 31 may be dot inversion, column inversion or other driving modes. In this embodiment, the dot inversion mode and column inversion mode are used for illustration. The driving mode selector 311 selects the dot inversion mode or the column inversion mode. After the driving mode selector 311 selects the dot inversion as the driving mode, the frequency control signal 312 is set as a high level (H); and after the driving mode selector 311 selects the column inversion as the driving mode, the frequency control signal 312 is set as a low level (L).

Also, after the driving mode selector 311 selects the dot inversion as the driving mode, a display panel 33 of the display is driven by a dot inversion driver 313 of the driving control device 31; and after the driving mode selector 311 selects the column inversion as the driving mode, the display panel 33 of the display is driven by a column inversion driver 314 of the driving control device 31.

The lamp frequency control device 32 receives the frequency control signal 312 and obtains at least one corresponding lamp frequency according to the frequency control signal 312. In the embodiment, the lamp frequency control device 32 utilizes a correspondence table 321 to obtain the corresponding lamp frequency. Therefore, where the correspondence table 321 receives the frequency control signal 312 at high level, it indicates that the driving mode selector 311 has selected dot inversion as the driving mode, and the lamp frequency is set to a frequency in the range of 44±3 KHz (as shown in FIG. 2A, no water flow interference is found within the frequency range). Where the correspondence table 321 receives the frequency control signal 312 at low level, it indicates that the driving mode selector 311 has selected column inversion as the driving mode, and the lamp frequency is set to a frequency in the range of 33±3 KHz (as shown in FIG. 2B, no water flow interference is found within the frequency range).

The lamp frequency obtained from the correspondence table 321 is output to a converter 322 of the lamp frequency control device 32. The converter 322 performs DC-to-AC conversion based on the lamp frequency as the operating frequency, so as to supply a desired power to the lamp 34.

Since the operating frequency of the converter 322 can be correspondingly adjusted to match the driving mode, regardless of that the driving control device 31 has selected a dot inversion mode or a column inversion mode, the operating frequency of the converter 322 can be switched to a frequency without water flow interference. Under such operating frequency, no water flow interference will occur in the display.

For stabilizing the current of the lamp 34, the lamp frequency control system 30 for the display of the invention further comprises a feedback circuit 35 for compensating the lamp current, so that the lamp 34 can stabilize the current of the lamp 34 while switching between different operating frequencies.

While an embodiment of the present invention has been illustrated and described, various modifications and improvements can be made by those skilled in the art. The embodiment of the present invention is therefore described in an illustrative, but not restrictive, sense. It is intended that the present invention may not be limited to the particular forms as illustrated, and that all modifications which maintain the spirit and scope of the present invention are within the scope as defined in the appended claims.

What is claimed is:

1. A lamp frequency control system for a display, comprising:

a driving control device, having a driving mode selector means for selecting a driving mode from at least two driving modes wherein said at least two driving modes are inversion modes; according to the selected driving mode, the driving mode selector means outputting at least one corresponding frequency control signal;

a lamp frequency control device means for obtaining at least one corresponding lamp frequency according to the frequency control signal.

2. The lamp frequency control system as claimed in claim 1, further comprising a converter for converting a direct current to an alternating current based on the lamp frequency as an operating frequency.

3. The lamp frequency control system as claimed in claim 1, wherein the lamp frequency control device has a correspondence table for obtaining at least one corresponding lamp frequency according to the frequency control signal.

4. The lamp frequency control system as claimed in claim 1, wherein the lamp frequency control device further comprises a feedback circuit for compensating the lamp current so as to stabilize lamp current.

5. A lamp frequency control system for a display, comprising:

a driving control device, having a driving mode selector for selecting a driving mode from at least two driving modes wherein said at least two driving modes are inversion modes; according to the selected driving mode, the driving mode selector outputting at least one corresponding frequency control signal;

a lamp frequency control device, for obtaining at least one corresponding lamp frequency according to the frequency control signal;

wherein the driving modes are dot inversion mode and column inversion mode.

6. The lamp frequency control system as claimed in claim 5, wherein the frequency control signal corresponding to the dot inversion mode is a high level signal, and the frequency control signal corresponding to the column inversion mode is a low level signal.

7. The lamp frequency control system as claimed in claim 5, wherein the lamp frequency corresponding to the dot inversion mode is 44±3 KHz, and the lamp frequency corresponding to the column inversion mode is 33±3 KHz.

8. A method for controlling lamp frequency for a display, comprising the steps of:

(a) selecting a driving mode from at least two driving modes wherein said at least two driving modes are inversion modes;

(b) outputting at least one corresponding frequency control signal according to the selected driving mode; and (c) obtaining at least one corresponding lamp frequency according to the frequency control signal.

9. The method as claimed in claim 8, further comprising a converting step for converting the direct current to the alternating current according to the lamp frequency.

10. The method as claimed in claim 8, further comprising a feedback step for compensating lamp current so as to stabilize the lamp current.

11. The lamp frequency control system as claimed in claim 1, wherein said at least two driving modes include a first inversion mode having a first scanning frequency and a second inversion mode having a second scanning frequency that is different from the first scanning frequency; and said lamp frequency control device comprises:

(i) a converter that is operable at a plurality of operating frequencies, including a first operating frequency that induces electromagnetic interference with the first scanning frequency of the first inversion mode of the first inversion mode but not with the second scanning frequency of the second inversion mode, and a second operating frequency that induces electromagnetic interference with the second scanning frequency of the second inversion mode but not with the first scanning frequency of the first inversion mode; and (ii) means for adjusting the operating frequency of the converter to a frequency selected from the plurality of operating frequencies that does not induce electromagnetic interference with the scanning frequency of the selected inversion mode.

* * * * *